US008037935B2

(12) United States Patent
Pelletier

(10) Patent No.: US 8,037,935 B2
(45) Date of Patent: Oct. 18, 2011

(54) ACQUIRING AND CONCENTRATING A SELECTED PORTION OF A SAMPLED RESERVOIR FLUID

(75) Inventor: Michael T. Pelletier, Houston, TX (US)

(73) Assignee: Halliburton Energy Services Inc., Houston, TX (US)

( * ) Notice: Subject to any disclaimer, the term of this patent is extended or adjusted under 35 U.S.C. 154(b) by 0 days.

(21) Appl. No.: 12/680,247

(22) PCT Filed: Sep. 2, 2008

(86) PCT No.: PCT/US2008/074979

§ 371 (c)(1),
(2), (4) Date: Mar. 26, 2010

(87) PCT Pub. No.: WO2010/027350

PCT Pub. Date: Mar. 11, 2010

(65) Prior Publication Data

US 2010/0252258 A1 Oct. 7, 2010

(51) Int. Cl.
*E21B 49/10* (2006.01)

(52) U.S. Cl. ..... 166/264; 166/100; 175/59

(58) Field of Classification Search ..... 166/264, 166/100; 73/152.23–152.28; 175/59
See application file for complete search history.

(56) References Cited

U.S. PATENT DOCUMENTS

| | | | | |
|---|---|---|---|---|
| 2,465,563 | A * | 3/1949 | Abrams | 436/29 |
| 5,077,017 | A | 12/1991 | Gorin et al. | |
| 5,281,258 | A | 1/1994 | Markovs | |
| 5,597,535 | A | 1/1997 | Schaedlich et al. | |
| 7,025,138 | B2 | 4/2006 | Kurkjian et al. | |
| 2003/0200788 | A1 | 10/2003 | Newbound | |
| 2007/0039731 | A1 | 2/2007 | Fox et al. | |
| 2007/0205021 | A1 | 9/2007 | Pelletier et al. | |

OTHER PUBLICATIONS

Arizona Instrument LLC, "Jerome 431-X Mercury Vapor Analyzer".
Arizona Instrument LLC, "Jerome 451 Mercury Monitoring System".
Metrohm, "New: 848 and 877 Titrino plus", *Metrohm Information Issue* Jan. 2008.

* cited by examiner

*Primary Examiner* — David Andrews
(74) *Attorney, Agent, or Firm* — Howard L. Speight

(57) ABSTRACT

An apparatus includes a sample compartment. The apparatus further includes an inlet port through which the sampled reservoir fluid may be introduced into the sample compartment. The apparatus further includes a concentrating object that can be placed within the sample compartment. The concentrating object includes an outer surface and an inner surface recessed from the outer surface. The inner surface is receptive to adsorbing the selected portion of the sampled reservoir fluid.

20 Claims, 8 Drawing Sheets

ACQUIRING AND CONCENTRATING A SELECTED PORTION OF A SAMPLED RESERVOIR FLUID

BACKGROUND

Reservoir fluids sometimes contain substances, such as mercury, that can be harmful to people and to equipment. It can be useful, but challenging, to detect such substances so that prophylactic measures can be taken before the reservoir fluids are produced.

DETAILED DESCRIPTION

In one embodiment, a formation testing tool includes a sample chamber with a concentrating object inside the sample chamber. In one embodiment, when reservoir fluid containing a selected portion, such as mercury, is received into the sample chamber, the concentrating object adsorbs the selected portion from the reservoir fluid. In one embodiment, upon returning to the surface, the selected portion can be desorbed from the concentrating object and the selected portion's concentration in the formation fluid can be computed.

Figure 1:
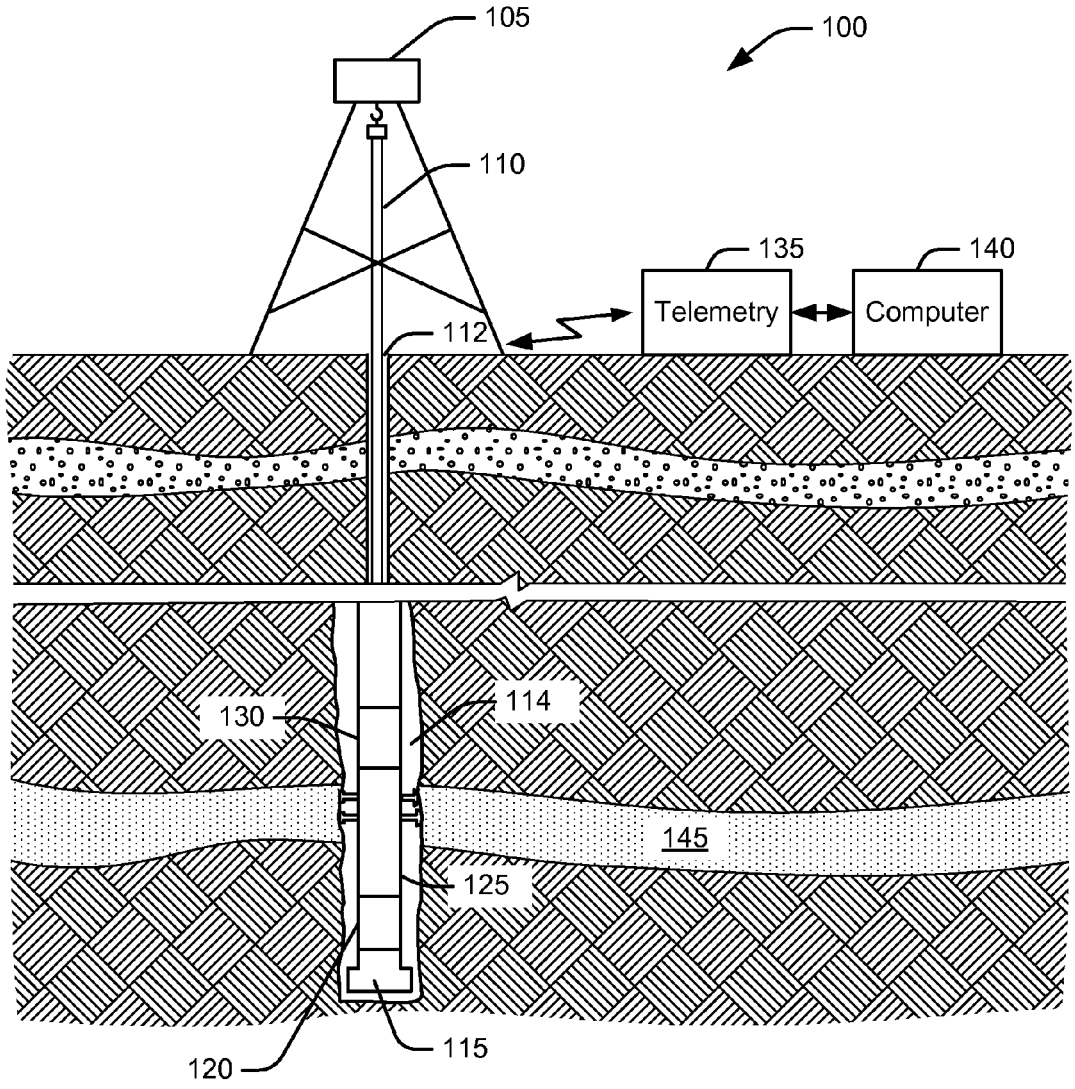
FIG. 1 illustrates a measure-while-drilling ("MWD") or logging-while-drilling ("LWD") environment.

An example environment 100, illustrated in FIG. 1, includes a derrick 105 from which a drill string 110 is suspended in a borehole 112. FIG. 1 is greatly simplified and for clarity does not show many of the elements that are used in the drilling process. In one embodiment, the volume within the borehole 112 around the drill string 110 is called the annulus 114. In one embodiment, the drill string includes a bit 115, a variety of actuators and sensors, shown schematically by element 120, a formation testing tool 125, and a telemetry section 130, through which the downhole equipment communicates with a surface telemetry system 135. In one embodiment, a computer 140, which in one embodiment includes input/output devices, memory, storage, and network communication equipment, including equipment necessary to connect to the Internet, receives data from the downhole equipment and sends commands to the downhole equipment.

The equipment and techniques described herein are also useful in a wireline or slickline environment. In one embodiment, for example, a formation testing tool may be lowered into the borehole 112 using wired drillpipe, wireline, coiled tubing (wired or unwired), or slickline. In one embodiment of a measurement-while-drilling or logging-while-drilling environment, such as that shown in FIG. 1, power for the formation testing tool is provided by a battery, by a mud turbine, or through a wired pipe from the surface, or through some other conventional means. In one embodiment of a wireline or slickline environment, power is provided by a battery or by power provided from the surface through the wired drillpipe, wireline, coiled tubing, or slickline, or through some other conventional means.

Figure 2:
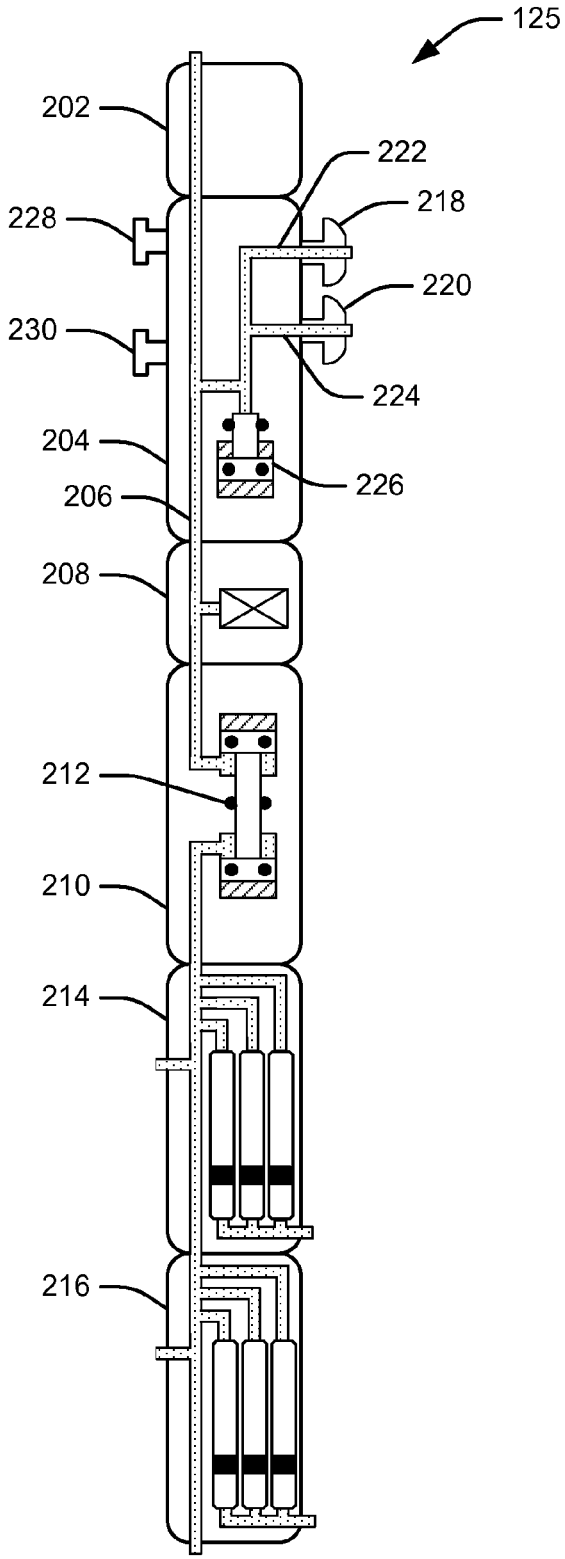
FIG. 2 is a schematic representation of one embodiment of a formation testing tool.

A more detailed, but still simplified, schematic of an embodiment of the formation testing tool 125 is shown in FIG. 2. In one embodiment, the formation testing tool 125 includes a power telemetry section 202 through which the tool communicates with other actuators and sensors 120 in the drill string, the drill string's telemetry section 130, and/or directly with the surface telemetry system 135. In one embodiment, the power telemetry section 202 is also the port through which the various actuators (e.g. valves) and sensors (e.g., temperature and pressure sensors) in the formation testing tool 125 are controlled and monitored. In one embodiment, the power telemetry section 202 includes a computer that exercises the control and monitoring function. In one embodiment, the control and monitoring function is performed by a computer in another part of the drill string (not shown) or by the computer 140 on the surface.

In one embodiment, the formation testing tool 125 includes a dual probe section 204, which extracts fluid from the reservoir, as described in more detail below, and delivers it to a channel 206 that extends from one end of the formation testing tool 125 to the other. In one embodiment, the channel 206 can be connected to other tools. In one embodiment, the formation testing tool 125 also includes a quartz gauge section 208, which includes sensors to allow measurement of properties, such as temperature and pressure, of the fluid in the channel 206. In one embodiment, the formation testing tool 125 includes a flow-control pump-out section 210, which includes a high-volume bidirectional pump 212 for pumping fluid through the channel 206. In one embodiment, the formation testing tool 125 includes two multi-chamber sections 214, 216, which are described in more detail below.

In one embodiment, the dual probe section 204 includes two probes 218, 220 which extend from the formation testing tool 125 and press against the borehole wall, as shown in FIG. 1. Returning to FIG. 2, probe channels 222, 224 connect the probes 218, 220 to the channel 206. The high-volume bidirectional pump 212 can be used to pump fluids from the reservoir, through the probe channels 222, 224 and to the channel 206. Alternatively, a low volume pump 226 can be used for this purpose. Two standoffs or stabilizers 228, 230 hold the formation testing tool 125 in place as the probes 218, 220 press against the borehole wall, as shown in FIG. 1. In one to embodiment, the probes 218, 220 and stabilizers 228, 230 are retracted when the tool is in motion and are extended to sample the formation fluids.

Figure 3:
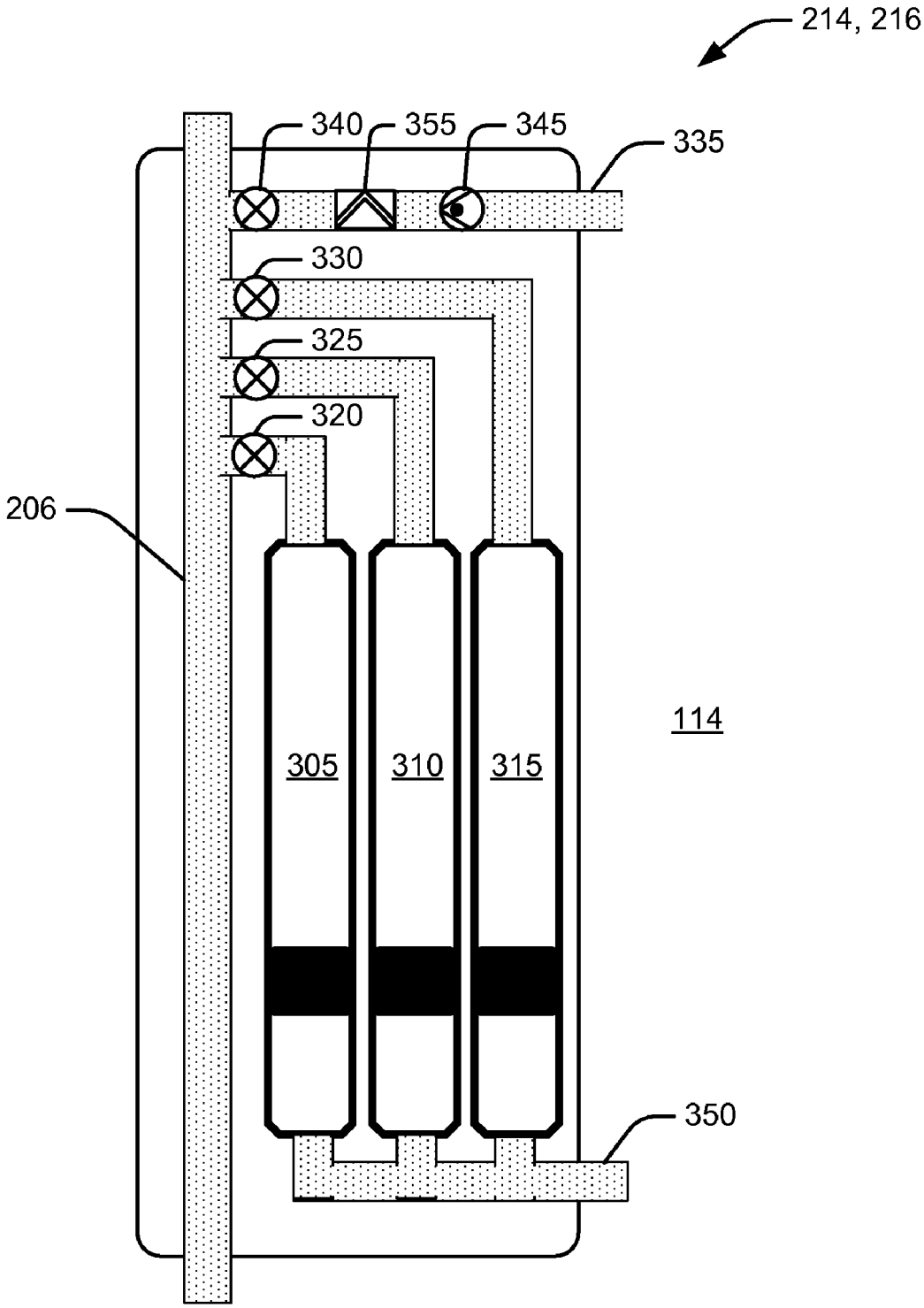
FIG. 3 is a schematic representation of one embodiment of a multi-chamber section.

In one embodiment, the multi-chamber sections 214, 216 include multiple sample chamber 305, 310, 315, as shown in FIG. 3. While FIGS. 2 and 3 shown the multi-chamber sections 214, 216 having three sample chambers 305, 310, 315, it will be understood that the multi-chamber sections 214, 216 can have any number of sample chambers. It will also be understood that multi-chamber section 214 can have a different number of sample chambers than multi-chamber section 216.

In one embodiment, the sample chambers 305, 310, 315 are coupled to the channel 206 through respective chamber valves 320, 325, 330. In one embodiment, reservoir fluid can be directed from the channel 206 to a selected sample chamber by opening the appropriate chamber valve. For example, reservoir fluid can be directed from the channel 206 to sample chamber 305 by opening chamber valve 320, reservoir fluid can be directed from the channel 206 to sample chamber 310 by opening chamber valve 325, and reservoir fluid can be directed from the channel 206 to sample chamber 315 by opening chamber valve 330. In one embodiment, when one chamber valve is open the others are closed.

In one embodiment, the multi-chamber sections 214, 216 include a path 335 from the channel 206 to the annulus 114 through a valve 340. Valve 340 is open during the draw-down period when the formation tester is clearing mud cake, drilling mud, and other contaminants into the annulus before clean formation fluid is directed to one of the sample chambers 305, 310, 315. A check valve 345 prevents fluids from the annulus 114 from flowing back into the channel 206 through the path 335. In one embodiment, the multi-chamber sections 214, 216 include a path 350 from the sample chambers 305, 310, 315 to the annulus 114.

Figure 4A:
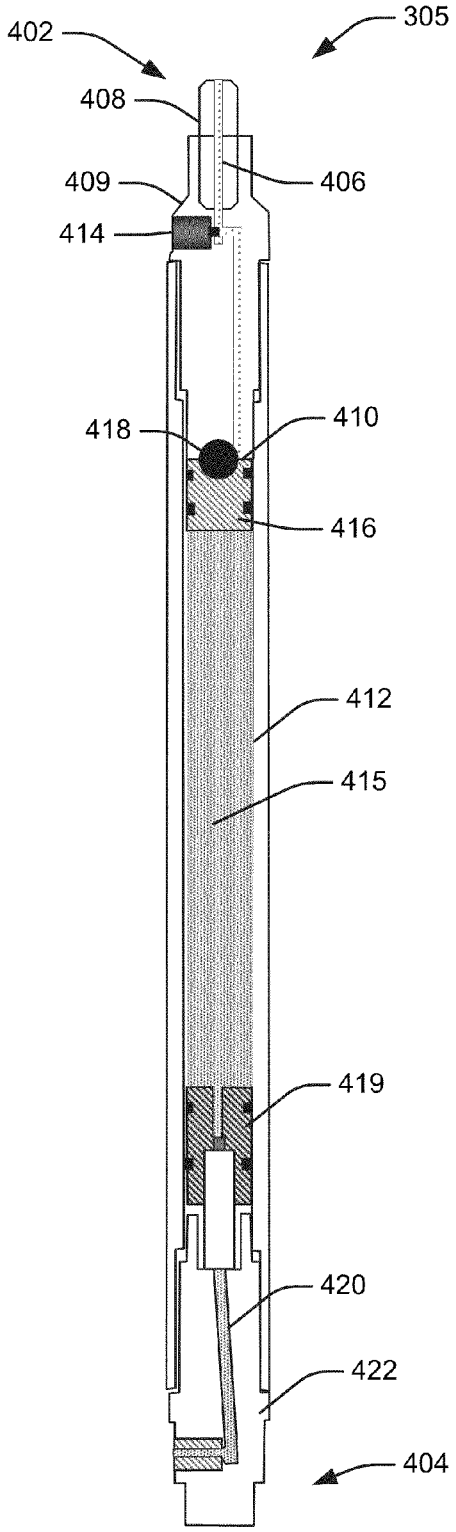
FIGS. 4A and 4B are cross-sectional representations of one embodiment of sample chambers.
Figure 4B:
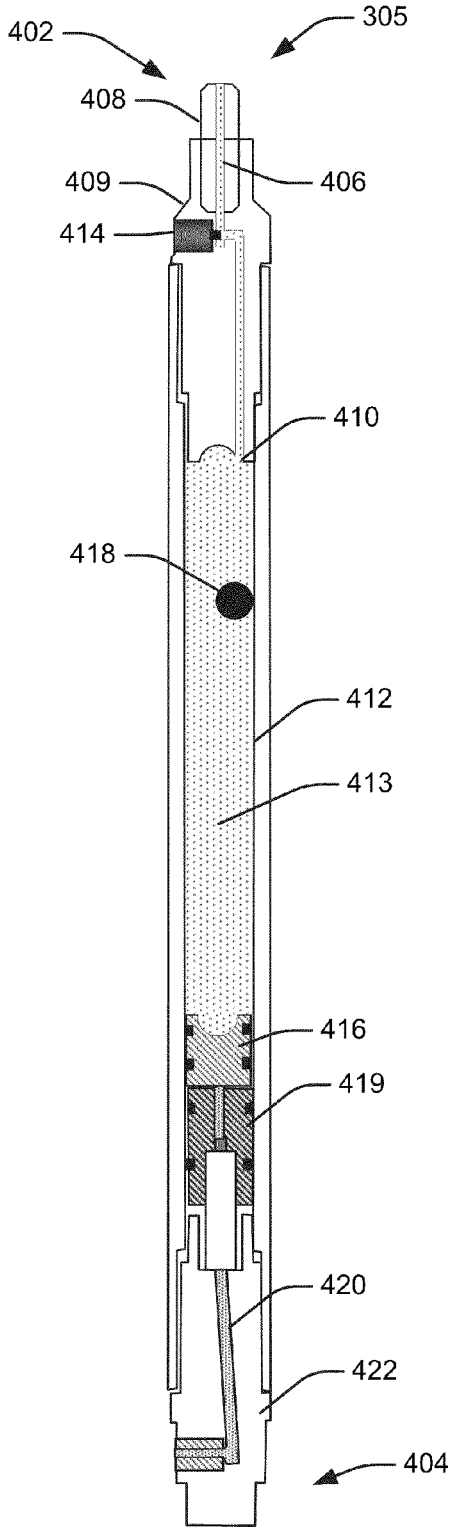

One embodiment of a sample chamber 305 (and in one embodiment 310 and 315) is illustrated in FIG. 4A, which shows the sample chamber before a sample is taken, and FIG. 4B, which shows the sample chamber after a sample is taken. In one embodiment, the sample chamber 305 has a channel end 402 and an annulus end 404. At the channel end 402, the sample chamber includes an inlet port 406 which communicates with the channel 206 through valve 320 (see FIG. 3). In one embodiment, the inlet port 406 proceeds through a connector 408 and a seal 409 to a vent 410 into a sample compartment 412. In one embodiment, the inlet port can be sealed by a valve 414, which provides a sufficient seal that the sample chamber 305 can be safely shipped when it is removed from the formation testing tool 125.

In one embodiment, as shown in FIG. 4A, the inlet port 406 is sealed by a sample piston 416, which is capable of traveling the entire length of the sample compartment 412. The sample piston 416 divides the sample compartment 412 into a sample side 413 on the side of the sample compartment 412 closest to the channel end 402 (shown most clearly in FIG. 4B), and an N2/mud side 415 on the side of the sample compartment 412 closest to the annulus end 404 (shown most clearly in FIG. 4A). The sizes of the sample side 413 and the N2/mud side 415 vary with movement of the sample piston 416. In the embodiment shown in FIG. 4A, the N2/mud side 415 of the sample compartment 412 is pressurized, for example with nitrogen gas, which causes the sample piston 416 to move toward the channel end 402 and seal the inlet port 406. In one embodiment, the pressurization of the N2/mud side 415 of the sample compartment 412 takes place at the surface before the sample chamber 305 is inserted into the formation testing tool 125.

In the embodiment shown in FIG. 4A, the inlet port 406 is also partially sealed by a concentrating object 418, discussed in more detail below. In one embodiment, the concentrating object fits into indentations in the seal 409 and sample piston 416 and partially obstructs the vent 410 when the sample piston 416 is pressed against the seal 409.

In one embodiment, the end of the sample compartment 412 closest to the annulus end 404 of the sample chamber 305 is sealed by an annulus piston 419, which moves back and forth within the sample compartment 412. An annulus path 420 communicates annulus fluids through an annulus seal 422 to the annulus piston 419, which moves to compress the fluid in the sample compartment 412 until its pressure substantially matches the annulus pressure.

In one embodiment, the annulus piston 419 is not present and the sample piston 416 performs the same function of compressing the fluid in the sample compartment 412 until its pressure matches the annulus pressure.

In the embodiment shown in FIG. 4B, a sample of formation fluid has been pumped into the sample side 413 of the sample compartment 412. To illustrate one way this might have been accomplished and referring to FIGS. 2, 3, 4A and 4B, one or both of the probes 218, 220 were extended until they were pressed against the borehole wall. One or both of the stabilizers 228, 230 were extended to hold the formation testing tool 125 in place laterally. The valve 340 opening path 335 was opened and the high-volume pump 212 was engaged until a determination was made that uncontaminated formation fluid was being drawn through the probes 218, 220. The valve 340 was then closed and the valves 320 and 414 were opened. This allowed formation fluid to flow through the inlet port 406 and through the vent 410 to engage the sample piston 416. The pressure developed by the high-volume pump was sufficient to overcome the annulus pressure. As a result, the sample piston 416 moved back into the sample compartment 412 and the sample side 413 of the sample compartment 412 filled with formation fluid. The sample side 413 of the sample compartment 412 continued to fill until it reached the state shown in FIG. 4B with the sample piston 416 against the annulus piston 419. Valve 320 was then closed, sealing the inlet port 406 and the sample compartment 412.

In one embodiment, as can be seen in FIG. 4B, when sample side 413 of the sample compartment 412 is partially or completely filled with formation fluid the concentration object 418 moves freely within the sample compartment 412. In one embodiment, the sample piston 416 releases the concentration object 418 so that it can move within the sample compartment 412 as the sample compartment 412 is filled. In one embodiment, the concentration object 418 is tethered by a flexible or rigid member within the sample compartment 412.

Figure 5A:
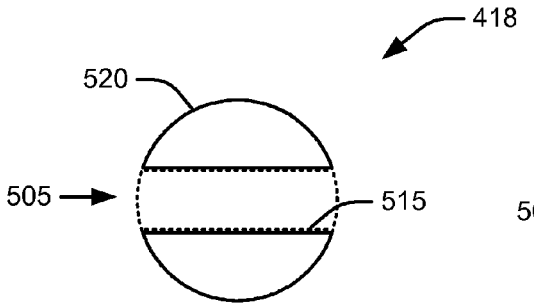
FIGS. 5A-5E illustrate embodiments of concentration objects.
Figure 5B:
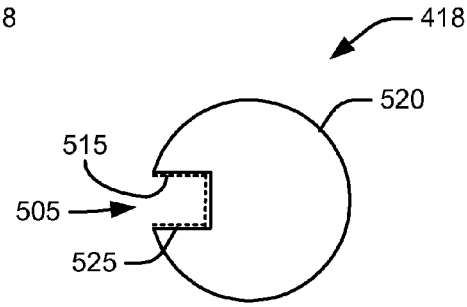
Figure 5C:
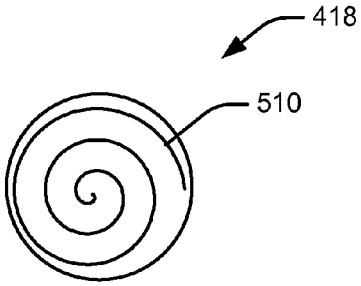

In one embodiment, the concentration object 418, is a ball, as shown in FIGS. 5A-5D. In one embodiment, the concentration object 418 is constructed of a material that can withstand the pressure, temperature and wear that it will experience downhole, such as, for example, metals, ceramics, or plastics which are not reactive with the reservoir fluids and are sufficiently robust to withstand the sample environment. Example materials include TiA16V4, Zirconium ceramics, and Teflon polymers. In one embodiment, the concentration object 418 has an aperture 505 cut into it. In various embodiments, the aperture can be a straight groove (i.e., a shallow slot), a straight slot 505 (such as that shown in FIGS. 5A and 5B), a spiral groove 510 (such as that shown in FIGS. 5C and 5D), a spiral slot (a deeper version of that shown in FIGS. 5C and 5D), and a hollow region (not shown). In one embodiment, the aperture 418 is coated with an adsorption agent 515, as shown in FIGS. 5A, 5B, and 5C. In one embodiment, the adsorption agent 515 can be applied in any suitable manner, including plating, painting, or gilding.

Figure 5E:
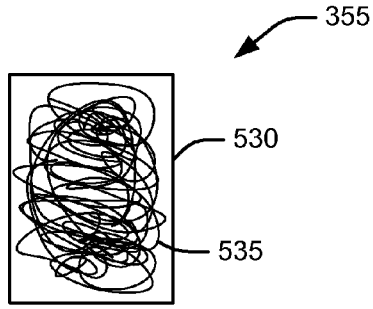
Figure 5D:
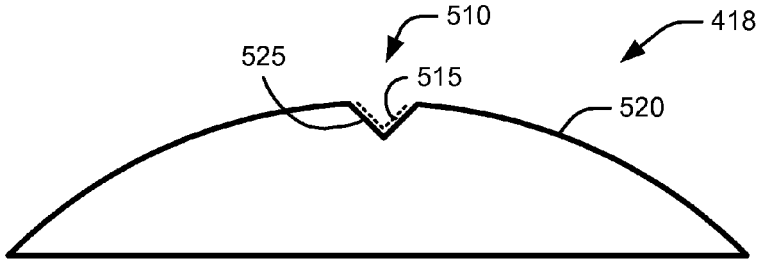

In one embodiment, the concentration object 418 has an outer surface 520, as shown in FIGS. 5A-5D. In one embodiment, the concentration object has an inner surface 525 recessed from the outer surface 520, as shown in FIGS. 5B and 5D. In one embodiment, the inner surface 525 is coated with an adsorption agent 515, as shown in FIGS. 5A-5D, so that it is receptive to adsorbing the selected portion of the sampled reservoir fluid.

In one embodiment, the adsorption agent 515 is selected to be receptive to adsorbing a selected portion from reservoir fluid. For example, in one embodiment, if the selected portion is mercury, one possible adsorption agent 515 would be gold. Referring to FIGS. 4B and 5A-D, if the concentration object's aperture 505 is coated with gold and the reservoir fluid contains mercury, the gold will adsorb the mercury and become an amalgam. The mercury would be trapped in the amalgam until it is desorbed.

It will be understood that the concentration object need not be the shape of a ball. It can have any shape that allows it to move within the sample compartment.

Figure 6:
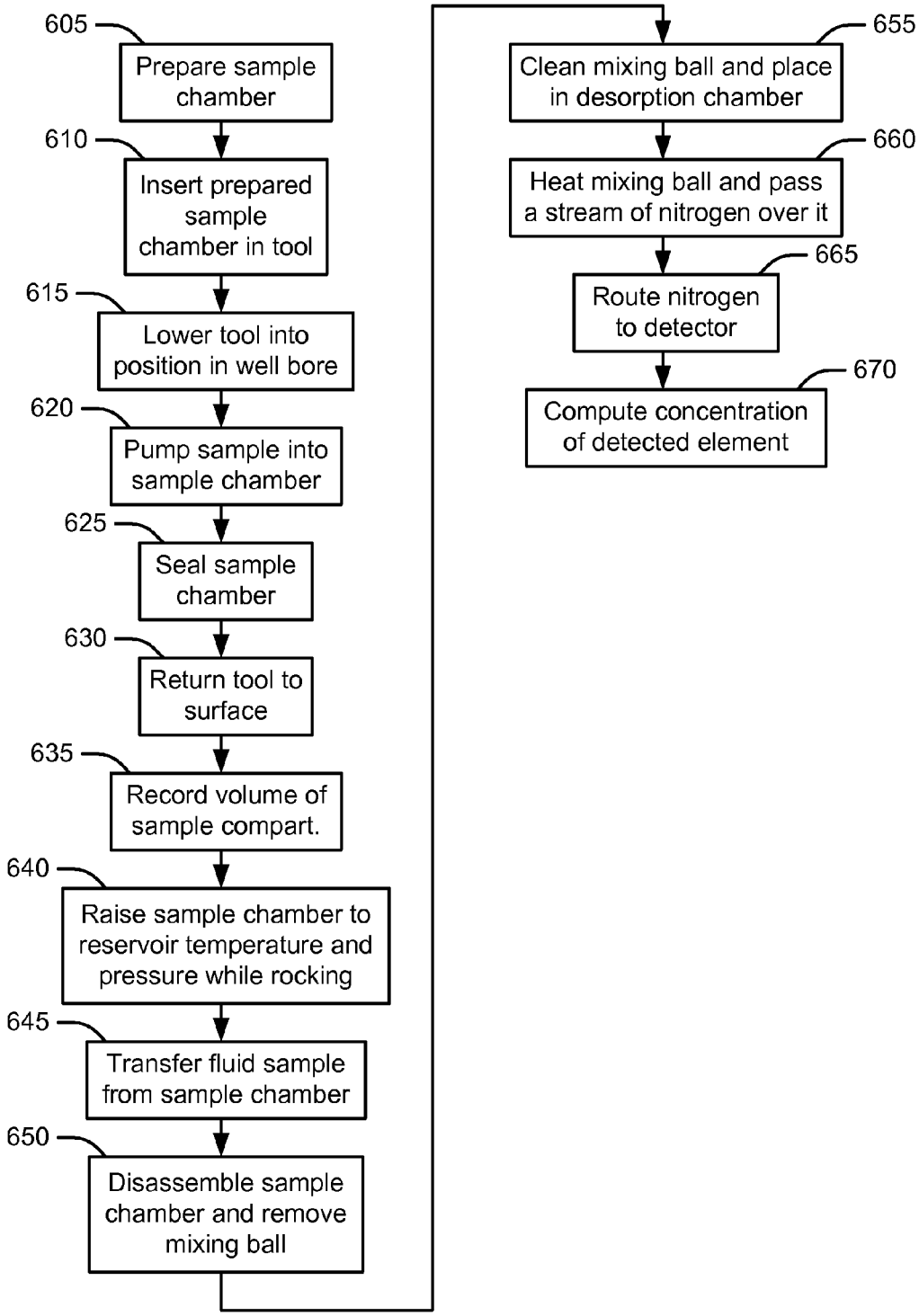
FIG. 6 is a flow chart illustrating one embodiment of the use of the formation testing tool.

In one embodiment, in operation, as shown in FIG. 6, a sample chamber 305 is prepared (block 605) by inserting a concentrating object into the sample side 413 of the sample compartment 412, and pressurizing the N2/mud side 415 of the sample compartment 412 with, for example, nitrogen (see FIG. 4). The prepared sample chamber 305 is then placed in the formation testing tool 125 (block 610). The tool is then lowered into position in the well bore (block 615). For example, in one embodiment, to sample the formation fluids from the formation 145 shown in FIG. 1, the tool would be lowered to the position shown in FIG. 1.

In one embodiment, a sample is then pumped into the sample side 413 of the sample chamber (block 620). In one embodiment, this would be done after going through the process described above of drawing down and eliminating the contaminated fluid before beginning the sample-taking process. In one embodiment, the sample chamber is then sealed (block 625) by, for example, closing valve 320 (see FIG. 3). At this point, in one embodiment, the sample chamber 305 is in the configuration shown in FIG. 4B, with the concentration object being in contact with the formation fluids and, since the formation testing tool 125, the sample chamber 305, and sample side 413 of the sample compartment 412 are at the elevated temperature and pressure present in the borehole, the concentration object begins to adsorb the selected portion (e.g. mercury) from the formation fluid.

The formation testing tool 125 is then returned to the surface (block 630) and the sample chamber 305 is prepared for removal from the tool 125 by shutting valve 414. In a wireline or slickline operation, this may be done immediately or almost immediately after the sample is taken. In a MWD or LWD operation, the return to the surface may not happen until some reason occurs to withdraw the entire drill string from the borehole.

In an alternative embodiment, it is not necessary to return the tool to the surface. The necessary equipment to perform the analysis are downhole, in one embodiment in the formation testing tool 125, and the results of the test are returned to the surface by telemetry.

Returning to the previous embodiment, at the surface the volume of the sample chamber is recorded (block 635). The sample chamber is raised to the reservoir temperature and pressure and is rocked (block 640), which moves the concentration object within the sample compartment, causing it to mix and come into intimate contact with the formation fluids therein, furthering the adsorption of the selected portion from the reservoir fluids. After a sufficient time (while thermodynamic equilibrium is desired, the actual time varies depending on customer requirements but can range from hours to days), when virtually the entire selected portion has been adsorbed by the concentrating object from the formation fluids, the fluid sample is transferred from the sample chamber (block 645). The sample chamber is disassembled and the concentration object is removed (block 650). The concentration objected is then cleaned and placed in a desorption chamber (block 655). The concentration object is then heated and a inert gas, such as nitrogen, is passed over it (block 660).

Figure 7:
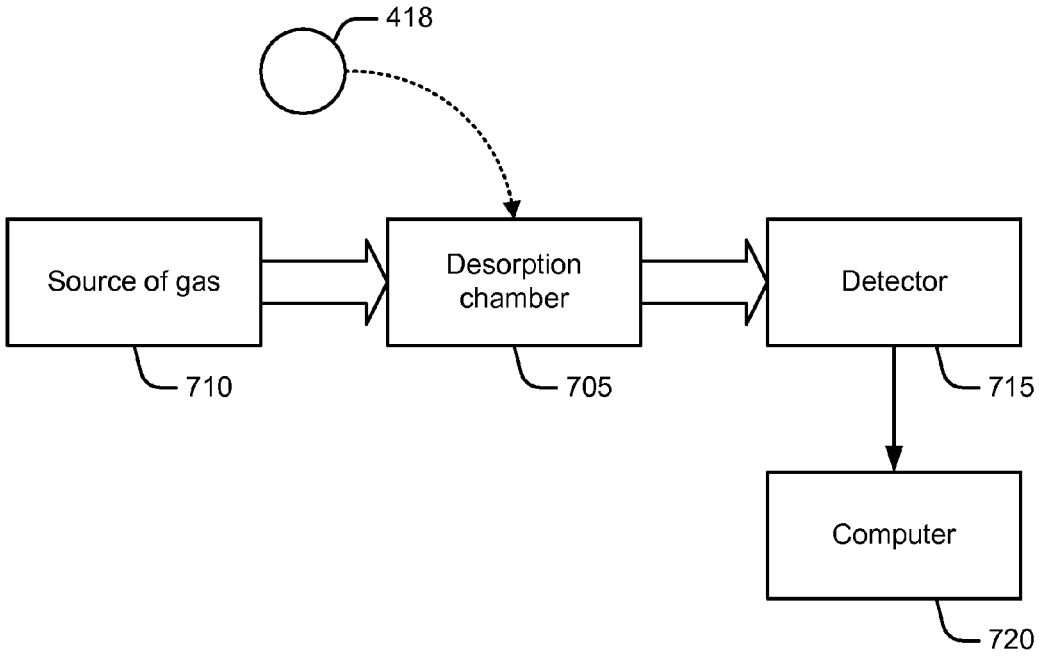
FIG. 7 illustrates one embodiment of equipment used in the desorption process.

One embodiment of the desorption apparatus is shown in FIG. 7. In one embodiment, the concentration object 418 is placed in a desorption chamber 705 where the selected portion (e.g. mercury) is desorbed from the concentration object 418. A source of gas, such as nitrogen, 710 is connected to the desorption chamber and the gas is passed over the concentration object, entraining the desorbed selected portion. The resulting mixed gas is routed (block 665) to a detector 715 which measures the concentration of the selected portion in the gas, which it reports to a computer 720. The computer takes that information plus the volume of the sample compartment that was recorded earlier and computes the concentration of the selected portion in the formation fluids (block 670).

Figure 8:
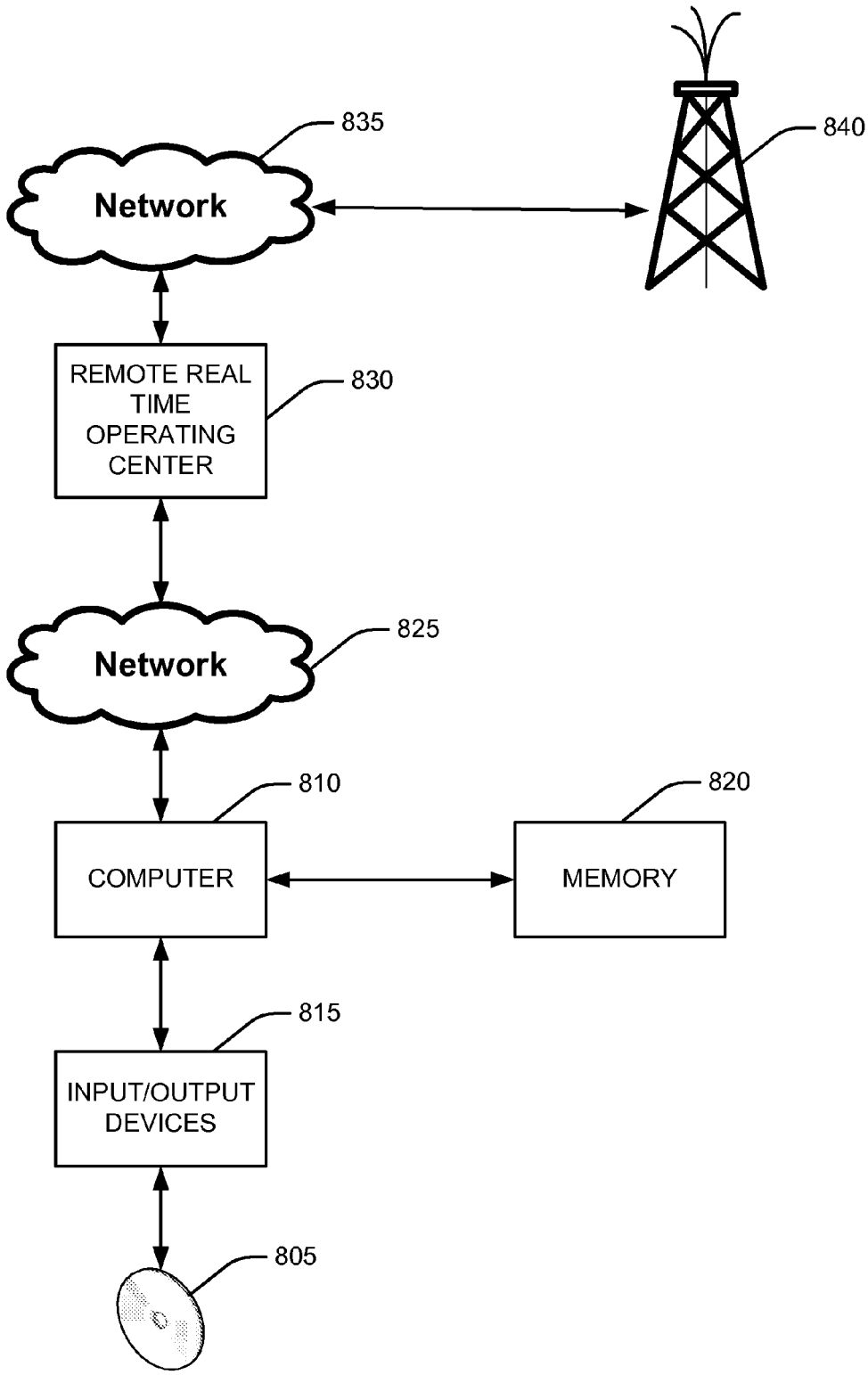
FIG. 8 illustrates one embodiment of a command and control environment.

In one embodiment, the status and control function for controlling the formation testing tool 125 is stored in the form of a computer program on a computer readable media 805, such as a CD or DVD, as shown in FIG. 8. In one embodiment a computer 810, which may be the same as computer 140 or which may be below the surface in the drill string, reads the computer program from the computer readable media 805 through an input/output device 815 and stores it in a memory 820 where it is prepared for execution through compiling and linking, if necessary, and then executed. In one embodiment, the system accepts inputs through an input/output device 815, such as a keyboard, and provides outputs through an input/output device 815, such as a monitor or printer. In one embodiment, the system stores the results of concentration calculations in memory 820 or modifies such calculations that already exists in memory 820.

In one embodiment, the results of concentration calculations that reside in memory 820 are made available through a network 825 to a remote real time operating center 830. In one embodiment, the remote real time operating center makes the results of concentration calculations, available through a network 835 to help in the planning of oil wells 840 or in the drilling of oil wells 840. Similarly, in one embodiment, the formation testing tool 125 can be controlled from the remote real time operating center 830.

In one embodiment, a removable concentration object 355 is inserted between valve 340 and check valve 345 (see FIG. 3) and the volume of fluid pumped out through path 335 is tracked, for example, by counting the number of strokes pumped by high-volume bidirectional pump 212. The concentration object can be treated as above and the concentration of the selected portion (e.g. mercury) in the fluids pumped through path 335 can be estimated. In one embodiment, illustrated in FIG. 5E, the concentration object 355 is a can 530 containing, for example, loose low density metal wire wool 535 at least partially coated with an adsorption agent 515. In another embodiment, the can 530 contains a bow tie style metal mixer (not shown) coated with an adsorption agent 515. In one embodiment, each of the multi-chamber sections 214 and 216 is configured as shown in FIG. 3 and includes a removable concentration object 355. In one embodiment, a valve system (including respective valves 340 in each of the multi-chamber sections 214 and 216) allows the concentration object 355 in a removable concentration object 355 in one of the multi-chamber sections 214, 216 to be exposed to reservoir fluids during the draw down period at one depth and the other to be exposed to reservoir fluids during the draw down period at another depth. In one embodiment, the valve system is controlled by a computer, such as, for example, by computer 140.

The text above describes one or more specific embodiments of a broader invention. The invention also is carried out in a variety of alternate embodiments and thus is not limited to those described here. The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

The invention claimed is:

1. An apparatus for acquiring and concentrating a selected portion of a sampled reservoir fluid, the apparatus comprising:

a sample compartment;

an inlet port through which the sampled reservoir fluid may be introduced into the sample compartment;

a concentrating object that can be placed within the sample compartment, the concentrating object comprising:

an outer surface; and an inner surface recessed from the outer surface, the inner surface being receptive to adsorbing the selected portion of the sampled reservoir fluid;

a member to hold the concentrating object in place in the sample compartment;

the member to release the concentrating object so that it can move within the sample compartment as the sample compartment is filled.

2. The apparatus of claim 1 wherein the concentrating object comprises a ball.

3. The apparatus of claim 1 wherein the inner surface comprises an aperture formed in the outer surface.

4. The apparatus of claim 3 wherein the aperture is selected from the group consisting of a straight groove, a straight slot, a spiral groove, a spiral slot, and a hollow region within the concentrating object.

5. The apparatus of claim 3 wherein the aperture is coated with an adsorption agent.

6. The apparatus of claim 1 wherein the selected portion is mercury and the inner surface is coated with gold.

7. The apparatus of claim 1 further comprising:

an access port through which the concentrating object can be placed in and retrieved from the sample compartment.

8. A method for acquiring and concentrating a selected portion of a sampled reservoir fluid, the method comprising:

inserting a concentrating object into a sample compartment;

securing the concentrating object in a secured position in the sample compartment;

inserting the sample compartment into a downhole tool;

lowering the downhole tool into a well bore;

receiving a sample of fluid from the reservoir into the sample compartment, the reservoir having a reservoir temperature and a reservoir pressure;

releasing the concentrating object from the secured position so that it can move within the sample compartment as the sample compartment receives the sample of fluid from the reservoir;

retrieving the downhole tool from the well bore;

removing the sample compartment from the downhole tool;

raising the sample compartment to substantially the reservoir temperature;

transferring the sample from the sample compartment;

removing the concentrating object from the sample compartment;

heating the concentrating object to desorb any of the selected portion that the concentrating object adsorbed from the sample;

passing an inert gas over the heated concentrating object; and measuring the concentration of the selected portion.

9. The method of claim 8 further comprising:

moving the concentrating object around within the sample compartment when the sample compartment is at substantially the reservoir temperature.

10. The method of claim 9 wherein moving the concentrating object around within the sample compartment comprises rocking the sample compartment.

11. The method of claim 8 further comprising measuring a volume of the sample.

12. The method of claim 11 further comprising computing the concentration of the selected portion in the sample from the measured concentration of the selected portion and a volume of the sample.

13. The method of claim 8 further comprising measuring a volume of reservoir fluid pumped when the sample was taken.

14. The method of claim 8 wherein lowering the downhole tool into a well bore comprises lowering the downhole tool in a configuration selected from the group consisting of an MWD configuration, an LWD configuration, and a wireline configuration.

15. An apparatus for acquiring and concentrating a selected portion of a sampled reservoir fluid, the apparatus comprising:

a probe to extend and engage a formation exposed in a well bore;

a pump coupled to the probe for pumping fluid from the formation;

a sample compartment coupled to the pump to receive at least a portion of the fluid pumped from the formation through the probe;

a concentrating object placed within the sample compartment, the concentrating object comprising:

an outer surface; and an inner surface recessed from the outer surface, the inner surface being receptive to adsorbing the selected portion of the sampled reservoir fluid;

a member to hold the concentrating object in place in the sample compartment;

the member to release the concentrating object so that it can move within the sample compartment as the sample compartment is filled.

16. The apparatus of claim 15 further comprising:

a plurality of other sample compartments, the sample compartment and the other sample compartments being selectively coupled to the pump to receive a portion of the fluid pumped from the formation through the probe.

17. The apparatus of claim 16 further comprising:

concentrating objects placed within at least some of the plurality of other sample compartments, each concentrating object comprising:

an outer surface; and an inner surface recessed from the outer surface, the inner surface being receptive to adsorbing the selected portion of the sampled reservoir fluid.

18. The apparatus of claim 15 wherein the concentrating object comprises a ball.

19. The apparatus of claim 15 wherein the inner surface comprises an aperture formed in the outer surface.

20. The apparatus of claim 19 wherein the aperture is coated with an adsorption agent.

* * * * *